US006612206B1

(12) United States Patent
Heggemann et al.

(10) Patent No.: US 6,612,206 B1
(45) Date of Patent: Sep. 2, 2003

(54) PLIERS

(75) Inventors: Christian Heggemann, Detmold (DE); Armin Herzog, Detmold (DE); Thorsten Bornefeld, Schlangen (DE)

(73) Assignee: Weidmuller Interface GmbH & Co., Detmold (DE)

( * ) Notice: Subject to any disclaimer, the term of this patent is extended or adjusted under 35 U.S.C. 154(b) by 0 days.

(21) Appl. No.: 09/644,673

(22) Filed: Aug. 24, 2000

(30) Foreign Application Priority Data

Aug. 24, 1999 (DE) ..... 299 14 764 U

(51) Int. Cl.[7] ..... B25B 7/12
(52) U.S. Cl. ..... 81/342; 81/392
(58) Field of Search ..... 81/342–344, 346–351, 81/384–386, 391–393, 313, 367; 72/409.01, 409.12

(56) References Cited

U.S. PATENT DOCUMENTS

| | | | | | |
|---|---|---|---|---|---|
| 3,243,880 | A | * | 4/1966 | Weller | 81/342 |
| 3,253,487 | A | * | 5/1966 | Bentley, Jr. | 81/342 |
| 3,888,003 | A | * | 6/1975 | Brown | 81/301 X |
| 4,048,877 | A | * | 9/1977 | Undin | 81/313 |

FOREIGN PATENT DOCUMENTS

| | | |
|---|---|---|
| DE | A1-3109289 | 1/1982 |
| DE | U1-29623005 | 12/1997 |
| DE | A1-19748034 | 5/1999 |
| WO | A1-9523048 | 8/1995 |

* cited by examiner

*Primary Examiner*—D. S. Meislin
(74) *Attorney, Agent, or Firm*—Birch, Stewart, Kolasch & Birch, LLP

(57) ABSTRACT

The invention relates to pliers having a first operating jaw (1) and a first plier handle (2) fixed thereto, having a second operating jaw (3) which is mounted pivotably by means of a pivot pin (30) and forms a plier mouth with the first operating jaw (1), having a second plier handle (4) which is mounted pivotably on a section (23) of the second operating jaw (3), said section being oriented towards the rear plier end, and having a resilient connecting element (7), of which one end is provided on the second plier handle (4), just behind the second operating jaw (3), and the other end is provided on the first plier handle (2). The pivot pin (30) is fastened on one of the operating jaws (3), and located in the other operating jaw (1) is a slot (33) for accommodating the pivot pin (30), the longitudinal direction of said slot running in the plier plane, at least more or less perpendicularly to the longitudinal direction of the pliers. A tension spring (5, 6) has one end fastened on the pivot pin (30) and its other end fastened on the operating jaw (1), which has the slot (33).

9 Claims, 5 Drawing Sheets

PLIERS

The invention relates to pliers.

Such pliers are already known from WO 95/23048. These known pliers contain a first operating jaw and a first plier handle fixed thereto, a second operating jaw which is mounted pivotably on the first operating jaw by means of a pivot pin and forms a plier mouth with the first operating jaw, a second handle which is mounted pivotably on that section of the second operating jaw which is oriented towards the rear plier end, and a resilient connecting element, of which one end is provided on the second plier handle, just behind the second operating jaw, and the other end is provided on the first plier handle.

In the case of these pliers, the connecting element serves for improving the elasticity of the pliers.

Further pliers of the type mentioned are known from DE 31 09 289 C2. In this case, a spring element is arranged in a force-transmission path such that the pliers give a smooth, comfortable actuation feel. The spring element may have, for example, V-shaped steel spring arms and be located between a pivot pin of one of the operating jaws and the other operating jaw, which has a slot for accommodating the pivot pin.

The object of the invention is to develop pliers of the type mentioned in the introduction such that better results can be achieved when working with them. In particular, it is intended to be possible to allow better self-adjustment of the force behaviour in the plier mouth in dependence on the closing movement of the operating jaws, to be precise also in relation to different sizes of objects which are to be processed in the plier mouth.

The solution of the set object consists in that the pivot pin is fastened on one of the operating jaws, and located in the other operating jaw is a slot for accommodating the pivot pin, the longitudinal direction of said slot running in the plier plane, at least more or less perpendicularly to the longitudinal direction of the pliers, and in that a tension spring has one end fastened on the pivot pin and its other end fastened on the operating jaw which has the slot.

The combination of tension spring and resilient connecting element makes it possible, according to the invention, for the force behaviour in the plier mouth to be adapted very precisely, in dependence on the closing movement of the operating jaws, to desired conditions, even for the case where objects of different sizes are to be processed in the plier mouth, with the result that better results may thus be achieved when working with the pliers. This applies, in particular, when the pliers constitute a crimping tool by means of which it is intended to press, for example, wire end ferrules or other contact elements onto ends of wires. The force behaviour in the plier mouth, in dependence on the closing movement of the operating jaws, is adjusted in that the respective spring characteristics of the tension spring and connecting element are combined with one another.

In this case, for the purpose of producing a desired force behaviour in the plier mouth, it is possible for the tension spring and the connecting element to be designed such that, over a closing displacement of the operating jaws which is limited by the length of the slot, the necessary mouth force is applied by the tension spring and the connecting element and, over a following closing displacement of the operating jaws, said force is provided solely by the connecting element.

Such a configuration is possible if the tension spring, which is otherwise used for the precise adjustment of the mouth force, would be over-extended in the case of the mouth forces being too large or the closing displacements of the operating jaws being too long. In this case, the tension spring is disengaged and the necessary mouth force is then applied, over a further closing displacement of the operating jaws, solely by the connecting element. This makes it possible to ensure, even over relatively large closing displacements of the operating jaws, the production of a desired force behaviour in the plier mouth.

According to one configuration of the invention, the spring characteristics of the tension spring and connecting element may be adapted to one another such that, once the closing displacement of the operating jaws which is limited by the length of the slot and further closing movement have been achieved, the smoothest possible force behaviour in the plier mouth is obtained.

This makes it possible to carry out a more uniform deformation operation in the plier mouth and thus to achieve an even better result when working with the pliers. This measure allows particularly favourable ergonomic handling of the pliers.

In one configuration of the invention, the connecting element may be designed such that it yields to a pronounced extent once it has exceeded a predetermined plier-mouth limit force. This avoids, during further closure of the plier handles, damage, in particular, to relatively large parts which are to be processed in the plier mouth, and it is made possible for a catch, which usually interacts with the pliers, to be disengaged from a row of teeth in order for it to be possible for the plier mouth to be opened.

In yet a further configuration of the invention, the pivot pin is preferably fastened on the second operating jaw, the slot being located in the first operating jaw. This makes it possible for the tension spring to be fastened on the first, non-movable operating jaw, with the result that it is not pivoted during operation of the pliers and its characteristic thus cannot be distorted.

The tension spring itself may be of any suitable form, but preferably it may also be designed, for example, as a V-shaped, U-shaped or Ω-shaped leaf spring. With springs of this type, the desired characteristic can be set particularly easily by selection of the appropriate dimensions and/or material thicknesses.

The connecting element used may preferably be a flat-plate-like spring plate or an assembly of such spring plates, it also being possible with these plates for the spring characteristic to be easily predetermined by appropriate material dimensions and material thicknesses.

An exemplary embodiment of the invention is explained in detail hereinbelow with reference to the drawing, in which.

Figure 1:
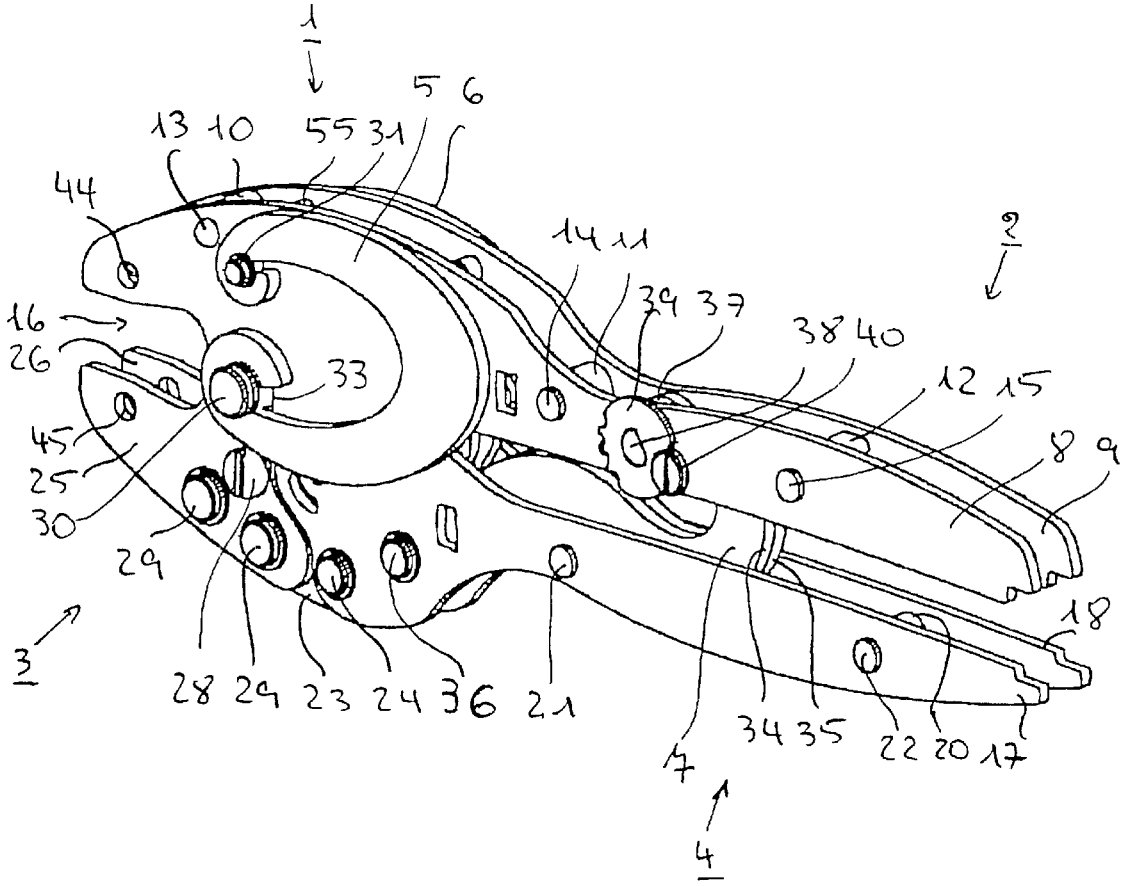
FIG. 1 shows a perspective view of the pliers according to the invention without handle shells.

According to FIG. 1, pliers according to the invention contain the following subassemblies: a first operating jaw 1, a first plier handle 2, a second operating jaw 3, a second plier handle 4, spring plates 5 and 6 designed in the form of a V, and a resilient connecting element 7, for example a compression spring.

The first operating jaw 1 and the first plier handle 2 are connected integrally to one another and overall comprise two mutually parallel plates 8 and 9 which are spaced apart from one another via a plurality of spacers 10, 11 and 12. The spacers 10, 11 and 12 each have a through-passage opening through which there runs a bolt 13, 14 and 15 which holds the plates 8 and 9 together.

In the front region, the first operating jaw 1 has a recess which is oriented in the direction of the second operating jaw 3 and is intended for forming a plier mouth 16 together with a corresponding recess in the second operating jaw 3.

The second plier handle 4 is designed in a manner corresponding to the first plier handle 2. It also comprises two parallel plates 17 and 18 which are spaced apart from one another via spacers 19 and 20. Said spacers 19 and 20 are likewise hollow and accommodate bolts 21 and 22 which hold the plates 17 and 18 together. In this case, the distance between the plates 17 and 18 corresponds to the distance between the plates 8 and 9.

The plates 17 and 18 are widened within their plane in their front region, which is oriented towards the plier mouth 16. They accommodate between them there a rear section 23 of the second operating jaw 3. Said rear section 23 of the second operating jaw 3 is mounted pivotably on the front region of the second plier handle 4 and, for this purpose, is arranged such that it can be rotated about a pin 24 which is retained by the plates 17 and 18 and passes through an opening 46 in the rear section 23.

Figure 2:
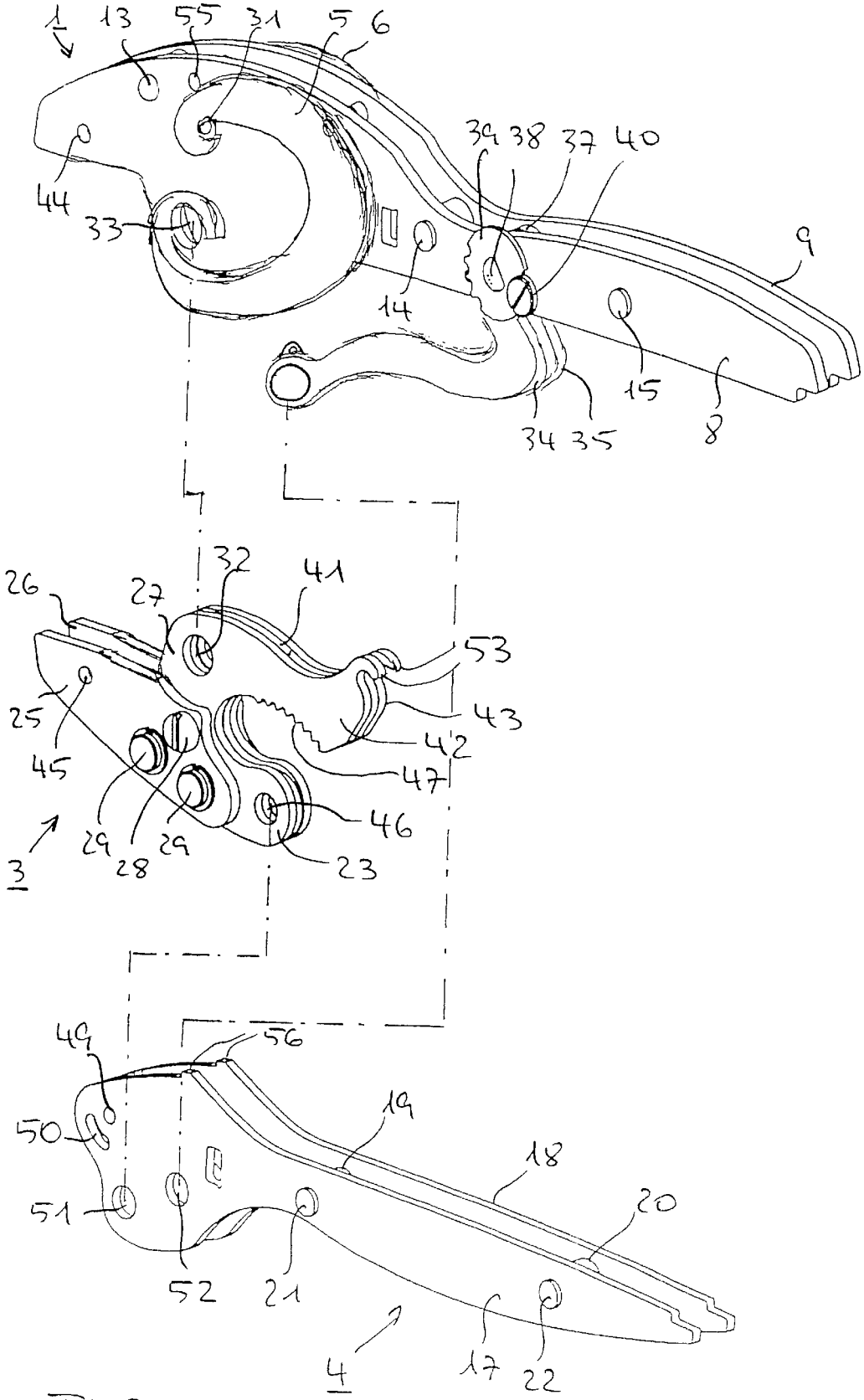
FIG. 2 shows an exploded illustration of the pliers according to FIG. 1.

As will be described in even more detail with reference to FIG. 2, the second operating jaw 3 has two lateral clamping-jaw plates 25 and 26 which fit closely against the sides of a central junction element 27 of the second operating jaw 3 and are spaced apart from one another by a distance which likewise corresponds to the distance between the plates 17, 18 and 8, 9. For the purpose of holding the clamping-jaw plates 25 and 26 together with the central junction element 27, use is made of screws 28 and bolts 29, which pass through said elements. Via a pivot pin 30, the second operating jaw 3, as will be explained with reference to FIG. 2, is mounted rotatably on the first operating jaw 1. Seated at both outer ends of the pivot pin 30, said ends projecting outwards beyond the second operating jaw 3, is in each case one end of the spring plates 5 and 6 which are designed in the form of a V and of which the other end is fastened in each case, via a bolt 31, on the top region of the top operating jaw 1, that is to say above the pivot pin 30. In this case, the pivot pin 30 fits in a recess 32 of the second operating jaw 3 and, on the other hand, is located in slots 33 which are located in each case in the plates 8 and 9 of the first operating jaw 1, the longitudinal direction of the slots 33 being located at least more or less perpendicularly to the longitudinal direction of the pliers.

The resilient connecting element 7 comprises two mutually parallel spring plates 34 and 35 and has its bottom end articulated in the front region of the second plier handle 4, for which purpose it can be pivoted about a pin 36 which passes through the connecting element 7 and is retained by the plates 17 and 18. The pin 36 is displaced towards the rear plier end in relation to the pin 24. The other end of the resilient connecting element 7 is mounted pivotably on an eccentrically mounted pin 37 and, via this, on the first handle 2. In this case, the eccentrically mounted pin 37 is displaced towards the rear end of the pliers in relation to the pin 36. For the eccentric mounting of the pin 37, use is made of journals 38, on both sides, which are mounted rotatably in the plates 8 and 9. Seated on one of said journals 38 is an adjusting disc 39 with border-side recesses which serve for arresting the angle position of the adjusting disc 39 by means of a screw 40. By adjusting the adjusting disc 39, it is possible, via the eccentric mounting of the connecting element 7, for the length of the latter to be changed and thus for the position of the operating jaws 1 and 3 in relation to one another to be adjusted.

FIG. 2 shows the construction of the pliers according to FIG. 1 in more detail. The same elements are once again provided with the same designations and will not be described again.

Clearly shown first of all, in the top part of FIG. 2, are the slots 33, of which the longitudinal direction runs perpendicularly to the longitudinal direction of the pliers. At a distance above the slots 33, in each case bolts 31 are located on the outside of the plates 8 and 9, said bolts serving for accommodating one end of the V-shaped spring plates 5 and 6. The respectively other end of the spring plates 5 and 6 is of curved design and the pivot pin 30, which is shown in FIG. 1, fits therein.

The central region of FIG. 2 shows the construction of the bottom operating jaw 3 in more detail. In the present case, the central junction element 27 comprises a central plate 41, which consists of plastic for example, and two outer plates 42 and 43, which butt against the two sides of the central plate 41 and are produced, for example, from steel. All the plates 41, 42 and 43 form an approximately U-shaped component, of which the free legs are oriented towards the rear plier end. The two clamping-jaw plates 25 and 26 are provided laterally on this component, in the region of the base and of the bottom leg, the plates being held together by the screw 28. The bolts 29 serve as rotation-prevention means, said bolts being retained via securing rings. The clamping-jaw plates 25 and 26 project from the base of the U-shaped component and form the plier mouth 16 together with the front sections of the plates 8 and 9. In the rear region of the plier mouth 16, both the clamping-jaw plates 25 and 26 and the plates 8 and 9 are bevelled, with the result that, towards the rear plier end, their opposite edges are spaced apart to an increasing extent from one another. Processing elements, borne by the clamping-jaw plates 25, 26 and the plates 8 and 9, in the plier mouth 16 may thus tilt in accordance with the closing position of the pliers, to be precise about respective tilting pins which are guided through openings 44 and 45 of the operating jaws 1 and 3 and retain the processing elements in the plier mouth 16.

The U-shaped component shown in the central region of FIG. 2 has, in the remaining region of its base, the through-passage opening 32 into which the pivot pin 30 fits. As has already been mentioned, said pivot pin 30 is accommodated by the slots 33, with the result that the second operating jaw 3 is mounted pivotably on the first operating jaw 1 in this way. The free end of the bottom leg of the U-shaped component in the central region of FIG. 2 forms said rear section 23 of the second operating jaw 3 and is provided there with a through-passage bore 46 through which the pin 24 runs in order for the second handle 4 to be mounted pivotably on the second operating jaw 3 in this way.

The top leg of the U-shaped component 27 in FIG. 2 has, on its inside, a toothing arrangement 47 which is located coaxially with the through-passage bore 46. Engaging in the toothing arrangement 47 is a catch 48, which can be seen in FIGS. 3 and 4. Said catch 48 may also be a pair of catches, of which in case one engages in a toothing arrangement 47 on one of the plates 42, 43. This makes it possible for the pliers to be reopened only once the plier handles have reached their closed position. In the front region of the bottom plier handle 4, the catch 48 is mounted such that it can be pivoted about a pin 49, which can be seen in the bottom part of FIG. 2. The pin 49 can be moved on a path concentric with the pin 24. The length of the catch 48 is thus longer than the distance between the pin 49 and toothing arrangement 47. Semicircular openings 50 coaxial with the pin 49 in the plates 17 and 18 serve for the manual actuation of the catch 48 in order to disengage it from the toothing arrangement 47. FIG. 2 also shows, in the front region of the second plier handle 4, through-passage openings 51 and 52 in the plates 17 and 18, which serve for accommodating the pins 24 and 36 in FIG. 1.

Figure 3:
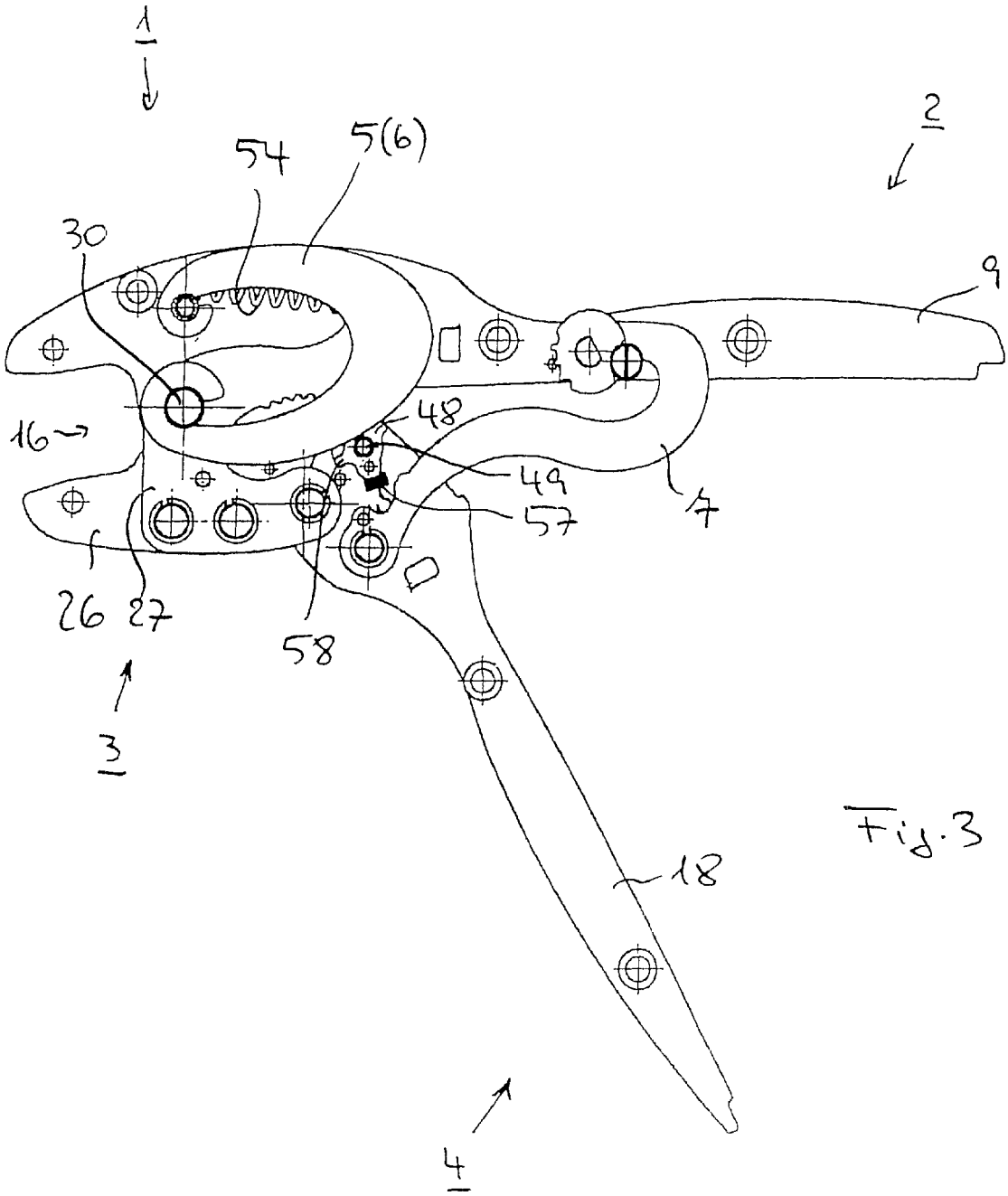
FIG. 3 shows a side view of the pliers according to FIG. 1 in the open state with the side plates removed, but with the Ω-spring inserted.
Figure 4:
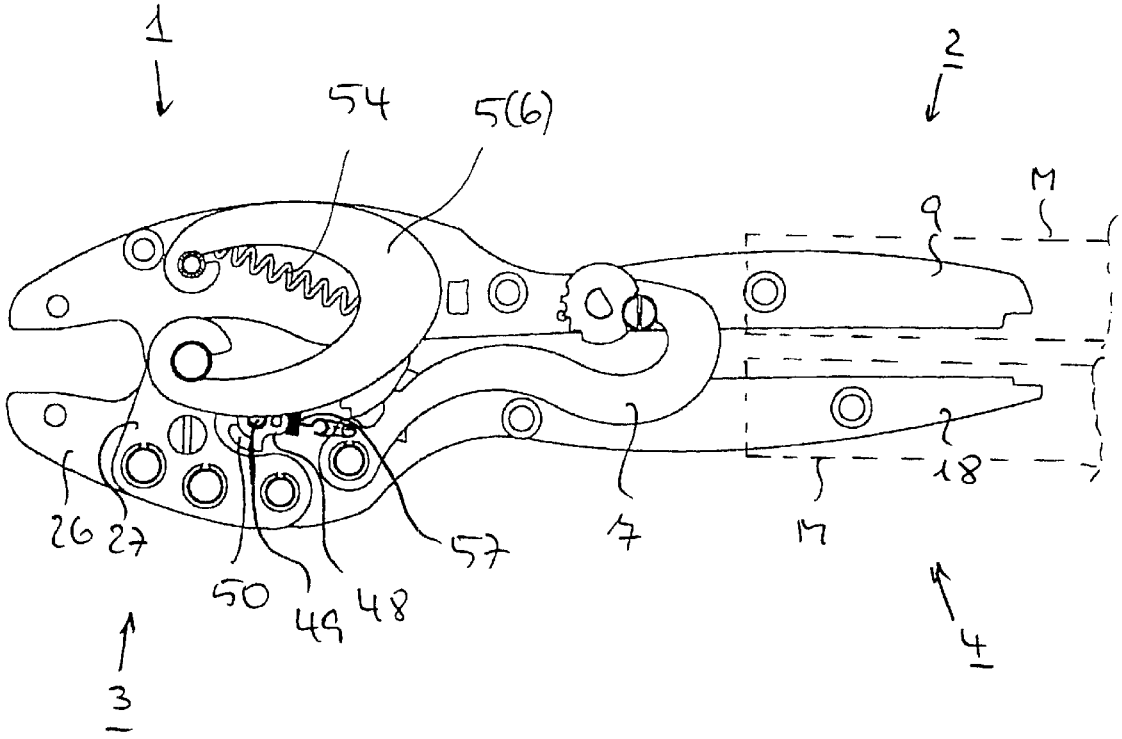
FIG. 4 shows a side view of the pliers according to FIG. 1 in the closed stated with the side plates removed, but with the Ω-spring inserted.

Hook-like extensions 53 at the rear end of the plates 42 and 43 can also be seen on the outside of the top leg of the central junction element 27 in FIG. 2. Said extensions 53, which may also be supplemented in order to provide through-passage openings, serve for accommodating a pin on which there is fastened one end of a tension spring which is shown in FIGS. 3 and 4 and is designated 54. The other end of said tension spring 54 is fastened on a pin 55 in the top region of the first operating jaw 1. The tension spring 54 serves for opening the pliers again automatically once the closed position of the plier handles 2, 4 has been reached. The closed position of the plier handles has been reached when the catch 48 is disengaged from the toothing arrangement 47. The top stops 56 on the second handle element 4 then subsequently strike against the bottom edges of the first handle element 2.

As far as FIGS. 3 and 4 are concerned, it should also be mentioned that the catch 48 can rotate about the pin 49 and by means of a spring 57, which is fastened in the bottom region of the connecting element 7, is retained in a zero position, which is only actually reached when the catch 48 is disengaged from the toothing arrangement 47. If the catch 48 is in engagement with the toothing arrangement 47, then it can yield, for example, as the plier mouth 16 closes and not in the opposite direction. In order to disengage the catch 48 from the toothing arrangement 47 in an intermediate position of the plier handles 2, 4, an extension 58 connected to the catch can be actuated manually through the slots 50. In practice, the catch 48 itself is located in the interior of the central junction element 27, with the result that there is no need for any additional space within the pliers for said ratchet mechanism comprising toothing arrangement 47 and catch 48. The pliers may thus be of relatively compact construction.

The functioning of the pliers will be explained in more detail hereinbelow with reference to FIGS. 3 and 4.

FIG. 3 shows the pliers in the fully open state. In this case, both the spring plates 5 and 6, which may also be referred to as a whole as the tension spring, and the connecting element 7 are relieved of loading.

If the plier handles 2 and 4 and plates 9 and 18 in FIG. 3 are moved towards one another, then the force in the plier mouth 16 is determined both by the spring plates 5 and 6 and by the connecting element 7. The characteristics of all the springs are added and result in a predetermined force behaviour in the plier mouth 16 in dependence on the closing movement of the operating jaws 1 and 3. The force behaviour in the plier mouth is defined here essentially by the spring plates 5 and 6, the pivot pin 30 being moved away downwards in FIG. 3, or moved away from the first operating jaw 1, as the plier handles are moved closed to an increasing extent.

If a relatively small object which is to be processed is located in the plier mouth 16, or between tool elements arranged there, and, accordingly, only a relatively short displacement of the operating jaws 1 and 3 is necessary, then, for this short operating displacement, it is possible to produce the force behaviour in the plier mouth essentially by the V-shaped spring plates 5 and 6, the connecting element 7 only giving a relatively small amount of assistance. The operating displacement then begins once the tool elements have come into contact with the object which is to be processed. Said spring plates can only be bent over the length of the slot 33 since it is only in this case that it is ensured that they actually provide the desired force behaviour. Bending of the spring plates 5 and 6 any further would result in the force behaviour being distorted since their elastic properties then change in an undefined manner.

If, on the other hand, objects which are to be processed in the plier mouth are to be deformed over a relatively long operating displacement, over which it is no longer possible for the V-shaped spring plates 5, 6 to provide the desired force behaviour, then, over the first part of the displacement, corresponding to the length of the slot, the force behaviour in the plier mouth 16 is determined essentially by the V-shaped spring plates, the connecting element 7 also influencing said force behaviour, whereas, following completion of the displacement permissible for the V-shaped spring plates 5 and 6, for the rest of the displacement, the force behaviour in the plier mouth is determined essentially solely by the spring properties of the connecting element 7. This ensures that the desired force behaviour is also actually available over the entire displacement path over which the element which is to be processed has to be processed or pressed in the plier mouth 16.

FIG. 4 shows the pliers in the fully closed state. In this case, all the spring elements 5, 6, 7 are still subjected to loading and the catch 48 has been disengaged from the toothing arrangement 47, with the result that the pliers can be opened again if a processed object (not illustrated) is located in the plier mouth 16.

Should the case occur where the plier handles 2, 4 are not yet closed even once the operating jaws 1, 3 have completed a closing displacement which goes beyond the closing displacement envisaged for the V-shaped spring plates, then, on account of its selected spring characteristic, the connecting element 7 ensures that in the event of an envisaged plier-mouth limit force being exceeded, on account of the compliant behaviour of the connecting element 7 which then commences, the plier handles may nevertheless be closed, with the result that the pliers can then be opened again.

Figure 5:
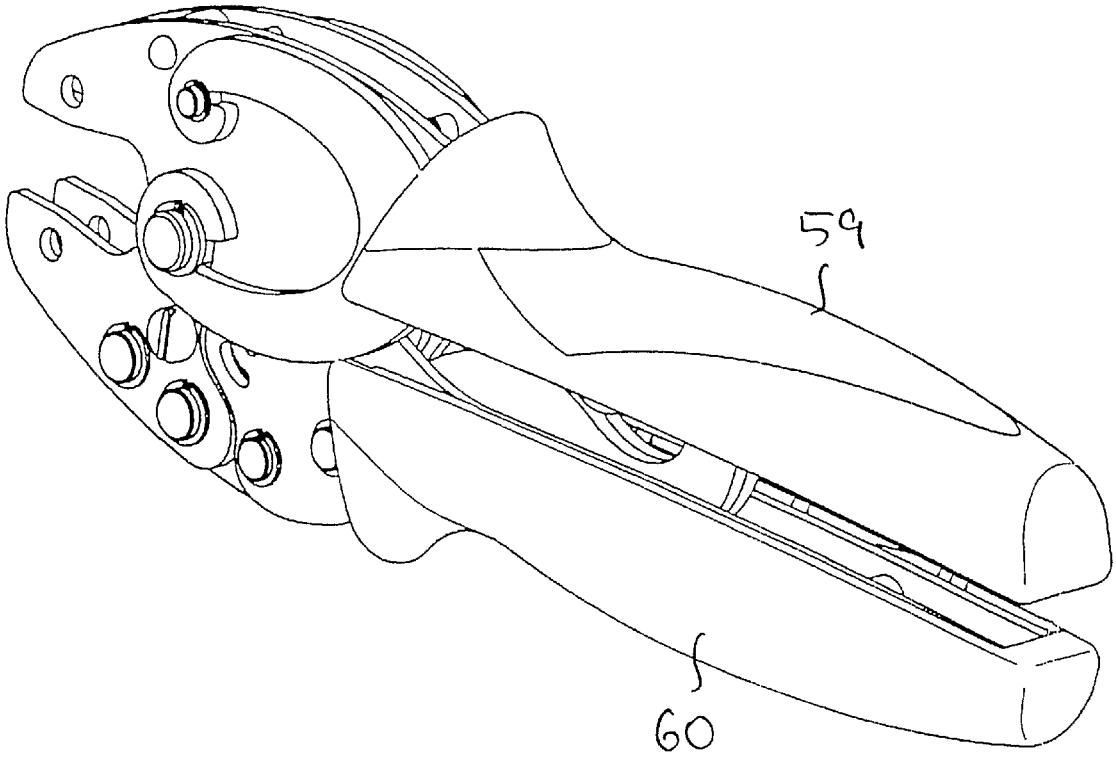
FIG. 5 shows a perspective view of the pliers according to the invention with handle shells.

FIG. 5 again shows the pliers according to the invention in a perspective view, in this case supplemented by handle shells 59 and 60 arranged on the plates 8, 9 and 17, 18.

The pliers according to the invention may be provided as an individual tool or as an integrated constituent part of a machine tool. In the case of an individual tool, it is possible, according to one configuration of the invention, for the plier handles 2, 4 to be designed such that it is also possible for the pliers to be connected, via their plier handles, to a machine for driving the pliers. This gives a number of possible applications for the pliers. They may thus be actuated manually or driven in a machine-controlled manner, in order for it to be possible to carry out periodically recurring operations over a relatively long period of time. On the other hand, it is also possible, however, for the pliers as a whole, or in parts, to be a permanent constituent part of a machine tool for driving the pliers. At least the plier handles may thus be parts of said machine tool. In this case, it would be possible for the plier handles to be capable of being coupled to the rest of the parts of the pliers, as a result of which the plier handles could be connected to respectively different plier parts of the type described above. It would thus be possible to take account of different dimensions of the objects which are to be processed.

FIG. 4 illustrates by dashed lines, for example, a machine M connected to the plier handles 2, 4. In practice, the machine M simulates the movement of the plier handles 2, 4 for driving the pliers.

What is claimed is:

1. Pliers comprising:

a first operating jaw;

a first plier handle fixed to said first operating jaw;

a second operating jaw forming a plier mouth with said first operating jaw;

a second plier handle mounted pivotably to said second operating jaw;

a resilient connecting element having a first end connected to said first plier handle and a second end connected to a portion of said second plier handle near said second operating jaw;

a pivot pin fastened to one of said first and second operating jaws;

a slot for receiving said pivot pin located in the other of said first and second operating jaws, said slot having a length of extension which is substantially perpendicular to a longitudinal extension direction of the pliers; and a tension spring having a first end fastened on said pivot pin and having a second end fastened on the other of said first and second operating jaws having said slot.

2. Pliers according to claim 1, wherein said tension spring and said resilient connecting element cooperate such that over a closing displacement of said first and second operating jaws which occurs when said pin is moving in said slot, a force applied by said first and second operating jaws to an object therebetween is applied primarily by a deformation of said tension spring.

3. Pliers according to claim 2, wherein said tension spring and said resilient connecting element cooperate such that over a closing displacement of said first and second operating jaws which occurs after said pin engages an end of said slot, a force applied by said first and second operating jaws to an object therebetween is applied to an increasing extent by a deformation of said resilient connecting element.

4. Pliers according to claim 1, wherein said resilient connecting element substantially yields once a predetermined force is applied by said first and second operating jaws on an object therebetween.

5. Pliers according to claim 1, wherein said pivot pin is fastened to said second operating jaw and said slot is located in said first operating jaw.

6. Pliers according to claim 1, wherein said tension spring is a V-shaped, U-shaped, or Ω-shaped leaf spring.

7. Pliers according to claim 1, wherein said resilient connecting element has at least one flat plate-like spring plate.

8. Pliers according to claim 1, wherein said first and second plier handles are adapted to be connected to a machine for imparting movement thereto.

9. A machine having a pliers apparatus comprising:

a first operating jaw;

a first plier handle fixed to said first operating jaw and forming a part of said machine;

a second operating jaw forming a plier mouth with said first operating jaw;

a second plier handle mounted pivotably on a section of said second operating jaw and forming a part of said machine;

a resilient connecting element having a first end connected to said first plier handle and a second end connected to a portion of said second plier handle near said second operating jaw;

a pivot pin fastened to one of said first and second operating jaws;

a slot for receiving said pivot pin located in the other of said first and second operating jaws, said slot having a length of extension which is substantially perpendicular to a longitudinal extension direction of the pliers; and a tension spring having a first end fastened on said pivot pin and having a second end fastened on the other of said first and second operating jaws having said slot.

* * * * *